US007148436B1

(12) United States Patent
Lee et al.

(10) Patent No.: US 7,148,436 B1
(45) **Date of Patent: *Dec. 12, 2006**

(54) MICROELECTROMECHANICAL ACCELERATION-SENSING APPARATUS

(75) Inventors: Robb M. Lee, Albuquerque, NM (US); Randy J. Shul, Albuquerque, NM (US); Marc A. Polosky, Albuquerque, NM (US); Darren A. Hoke, Albuquerque, NM (US); George E. Vernon, Rio Rancho, NM (US)

(73) Assignee: Sandia Corporation, Albuquerque, NM (US)

( * ) Notice: Subject to any disclaimer, the term of this patent is extended or adjusted under 35 U.S.C. 154(b) by 372 days.

This patent is subject to a terminal disclaimer.

(21) Appl. No.: 10/641,860

(22) Filed: Aug. 14, 2003

(51) Int. Cl.
*H01H 35/02* (2006.01)

(52) U.S. Cl. ..... 200/61.48; 200/181

(58) Field of Classification Search ..... 200/61.48, 200/61.45 R–61.53, 181
See application file for complete search history.

(56) References Cited

U.S. PATENT DOCUMENTS

| | | | | |
|---|---|---|---|---|
| 4,986,184 | A | 1/1991 | Kude | 102/256 |
| 5,177,331 | A * | 1/1993 | Rich et al. | 200/61.45 R |
| 5,415,043 | A * | 5/1995 | Zabler et al. | 73/514.38 |
| 5,457,293 | A * | 10/1995 | Breed | 200/61.52 |
| 5,501,893 | A | 3/1996 | Laermer | 428/161 |
| 5,664,665 | A * | 9/1997 | Kobayashi et al. | 200/61.45 M |
| 5,693,906 | A | 12/1997 | Van Sloun | 102/251 |
| 5,705,767 | A | 1/1998 | Robinson | 102/231 |
| 5,990,427 | A | 11/1999 | Lammert | 200/61.53 |
| 6,064,013 | A | 5/2000 | Robinson | 200/61.53 |
| 6,130,464 | A | 10/2000 | Carr | 257/417 |
| 6,153,839 | A * | 11/2000 | Zavracky et al. | 200/181 |
| 6,167,809 | B1 | 1/2001 | Robinson | 102/235 |
| 6,173,650 | B1 | 1/2001 | Garvick | 102/202.5 |
| 6,199,874 | B1 | 3/2001 | Galvin | 280/5.514 |
| 6,314,887 | B1 * | 11/2001 | Robinson | 102/262 |
| 6,321,654 | B1 | 11/2001 | Robinson | 102/251 |
| 6,377,187 | B1 * | 4/2002 | Fong | 340/686.1 |
| 6,401,621 | B1 | 6/2002 | Davis | 102/232 |
| 6,431,071 | B1 | 8/2002 | Hodge | 102/254 |
| 6,453,746 | B1 | 9/2002 | Polosky | 73/530 |
| 6,568,329 | B1 | 5/2003 | Robinson | 102/231 |
| 6,586,691 | B1 | 7/2003 | Itoigawa | 200/61.49 |
| 6,622,629 | B1 | 9/2003 | Hodge | 102/235 |
| 6,685,218 | B1 * | 2/2004 | Breed et al. | 280/730.2 |
| 6,737,979 | B1 | 5/2004 | Smith | 340/665 |
| 6,765,160 | B1 * | 7/2004 | Robinson | 200/61.45 R |
| 6,797,899 | B1 * | 9/2004 | Itoigawa et al. | 200/61.48 |
| 6,867,381 | B1 * | 3/2005 | Pan | 200/61.52 |
| 2003/0070571 | A1 | 4/2003 | Hodge | 102/221 |

* cited by examiner

*Primary Examiner*—Richard K. Lee
(74) *Attorney, Agent, or Firm*—John P. Hohimer

(57) ABSTRACT

An acceleration-sensing apparatus is disclosed which includes a moveable shuttle (i.e. a suspended mass) and a latch for capturing and holding the shuttle when an acceleration event is sensed above a predetermined threshold level. The acceleration-sensing apparatus provides a switch closure upon sensing the acceleration event and remains latched in place thereafter. Examples of the acceleration-sensing apparatus are provided which are responsive to an acceleration component in a single direction (i.e. a single-sided device) or to two oppositely-directed acceleration components (i.e. a dual-sided device). A two-stage acceleration-sensing apparatus is also disclosed which can sense two acceleration events separated in time. The acceleration-sensing apparatus of the present invention has applications, for example, in an automotive airbag deployment system.

20 Claims, 8 Drawing Sheets

MICROELECTROMECHANICAL ACCELERATION-SENSING APPARATUS

GOVERNMENT RIGHTS

This invention was made with Government support under Contract No. DE-AC04-94AL85000 awarded by the U.S. Department of Energy. The Government has certain rights in the invention.

CROSS REFERENCE TO RELATED APPLICATIONS

This application is related to co-pending application Ser. No. 10/641,980 entitled "Microelectromechanical Safing and Arming Apparatus" filed on Aug. 14, 2003.

FIELD OF THE INVENTION

The present invention relates in general to microelectromechanical (MEM) devices, and in particular to a MEM acceleration-sensing apparatus which can perform an electrical switch closure upon sensing a predetermined threshold level of acceleration. The apparatus has applications, for example, for use in an automotive airbag deployment system for crash protection.

BACKGROUND OF THE INVENTION

The determination of a moment of impact using an acceleration sensor is important for certain applications including automotive crash protection using one or more airbags which must be deployed promptly after impact to limit personal injury of an automobile's occupants. Acceleration sensing devices formed by silicon micromachining have been disclosed (see e.g. U.S. Pat. No. 6,199,874). These acceleration sensing devices, which have been formed as microelectromechanical (MEM) devices, generally utilize a structure having a plurality of interdigitated fingers for determining changes in acceleration due to a change in capacitance upon movement of the interdigitated fingers. No latching capability is provided in such devices.

The present invention represents an advance over the prior art by providing an acceleration-sensing apparatus which has a latching capability for sensing the occurrence of an acceleration component and then permanently completing an electrical circuit to indicate the occurrence of the acceleration component.

The acceleration-sensing apparatus of the present invention does not sense small changes in acceleration, but rather senses the occurrence of an acceleration component directed along an axis of the device which exceeds a predetermined acceleration threshold (e.g. due to an impact). Once the predetermined acceleration threshold is sensed, the apparatus of the present invention is permanently latched until mechanically released to provide an electrical switch closure that can be used for the activation of certain peripheral devices (e.g. an electronic control unit for igniting a gas generator for inflating an airbag) used in conjunction with the acceleration-sensing apparatus.

The acceleration-sensing apparatus of the present invention can be formed as a uni-directional or bi-directional device. Additionally, certain embodiments of the acceleration-sensing apparatus of the present invention can be utilized to sense the occurrence of multiple acceleration events separated in time.

These and other advantages of the present invention will become evident to those skilled in the art.

SUMMARY OF THE INVENTION

The present invention relates to an acceleration-sensing apparatus which comprises a suspended mass (i.e. a shuttle) that is moveable along an axis in response to an applied acceleration component, with an extent of movement of the mass being proportional to a magnitude of the applied acceleration component; a latch located proximate to the mass to capture and hold the mass when the extent of movement of the mass exceeds a threshold value; and an electrical circuit formed, at least in part, by the mass and the latch for indicating when the mass has been captured by the latch and thereby indicating that an acceleration event has occurred.

The mass, which generally comprises a flat plate, is preferably suspended by a plurality of springs and can further be surrounded by a frame. A subbase can be attached to the frame, with each spring being attached at one end thereof to the mass and at the other end thereof to a support extending upward from the subbase. Additionally, a lid can be attached to the frame on a side of the frame opposite the subbase. In certain preferred embodiments of the present invention, the mass and latch can be formed, at least in part, from a material (e.g. monocrystalline silicon) wherefrom the frame is formed.

The latch can comprise a barbed end for engagement with the mass to capture and hold the mass, and can further comprise a cantilevered beam with the barbed end being located at a free end of the cantilevered beam. An electrically-conductive layer (e.g. a metal) can be disposed over at least a portion of the mass and over at least a portion of the latch to form an electrical circuit which is completed (i.e. made electrically conductive) when the mass is captured and held firmly in place by the latch. A stop can also be provided in the apparatus to prevent movement of the mass substantially beyond the threshold value of the acceleration component wherein the mass is captured and held by the latch.

The present invention also relates to an apparatus for sensing acceleration which comprises a substrate (e.g. a semiconductor substrate such as a silicon substrate); a shuttle formed from the substrate and suspended for movement along an axis in response to an applied acceleration component; a latch for capturing and holding the shuttle when an extent of movement of the shuttle exceeds a threshold value in response to the applied acceleration component; and an electrical circuit formed, at least in part, from the shuttle for indicating when the shuttle is captured by the latch and thereby indicating the occurrence of the applied acceleration component. The electrical circuit can comprise an electrically-conductive layer (e.g. comprising a metal) which is disposed over at least a portion of the mass and over at least a portion of the latch.

The shuttle can be suspended by a plurality of springs, with each spring being attached at one end thereof to the shuttle and being attached at another end thereof to a support formed, at least in part, from the substrate. The latch can comprise at least one cantilevered beam having a catch at a free end thereof, with the catch further comprising a barb formed at the free end of each cantilevered beam.

A package can be formed about the substrate, with the package further comprising a subbase attached to an underside of the substrate, and a lid attached to a topside of the substrate. In certain preferred embodiments of the present invention, the subbase can be fusion bonded to the substrate.

The present invention also relates to an apparatus for sensing a plurality of acceleration events separated in time which comprises a first acceleration sensor for sensing a first acceleration event and a second acceleration sensor for sensing a second acceleration event. The first acceleration sensor can comprise a first suspended mass (i.e. a first shuttle) moveable in response to the first acceleration event over an extent of movement sufficient for the first mass to be captured by a first latch located proximate thereto, with the first mass upon capture by the first latch forming a completed electrical circuit. The second acceleration sensor can comprise a second suspended mass (i.e. a second shuttle) and a second latch located proximate thereto, and can further include a moveable stop located in a path of the second mass for limiting movement of the second mass until after formation of the completed electrical circuit whereupon the stop is moved out of the path of the second mass to enable movement thereof in response to the second acceleration event, with the second mass upon capture by the second latch forming another completed electrical circuit. The first and second acceleration events can be separated in time by, for example, a fraction of a second or more.

The first and second masses can be substantially equal in mass or can be different in mass. In certain embodiments of the present invention, the first and second masses can be formed from a common substrate (e.g. comprising silicon). Each latch can comprise a cantilevered beam having a barbed end for engagement with the mass located proximate thereto. Each electrical circuit can comprise an electrically-conductive layer (e.g. a metal) disposed over at least a portion of one of the masses and one of the latches located proximate thereto. The stop can be moved out of the path of the second mass by a microelectromechanical actuator, with the microelectromechanical actuator comprising an electrostatic actuator or a thermal actuator.

Additional advantages and novel features of the invention will become apparent to those skilled in the art upon examination of the following detailed description thereof when considered in conjunction with the accompanying drawings. The advantages of the invention can be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several aspects of the present invention and, together with the description, serve to explain the principles of the invention. The drawings are only for the purpose of illustrating preferred embodiments of the invention and are not to be construed as limiting the invention. In the drawings.

DETAILED DESCRIPTION OF THE INVENTION

Figure 1:
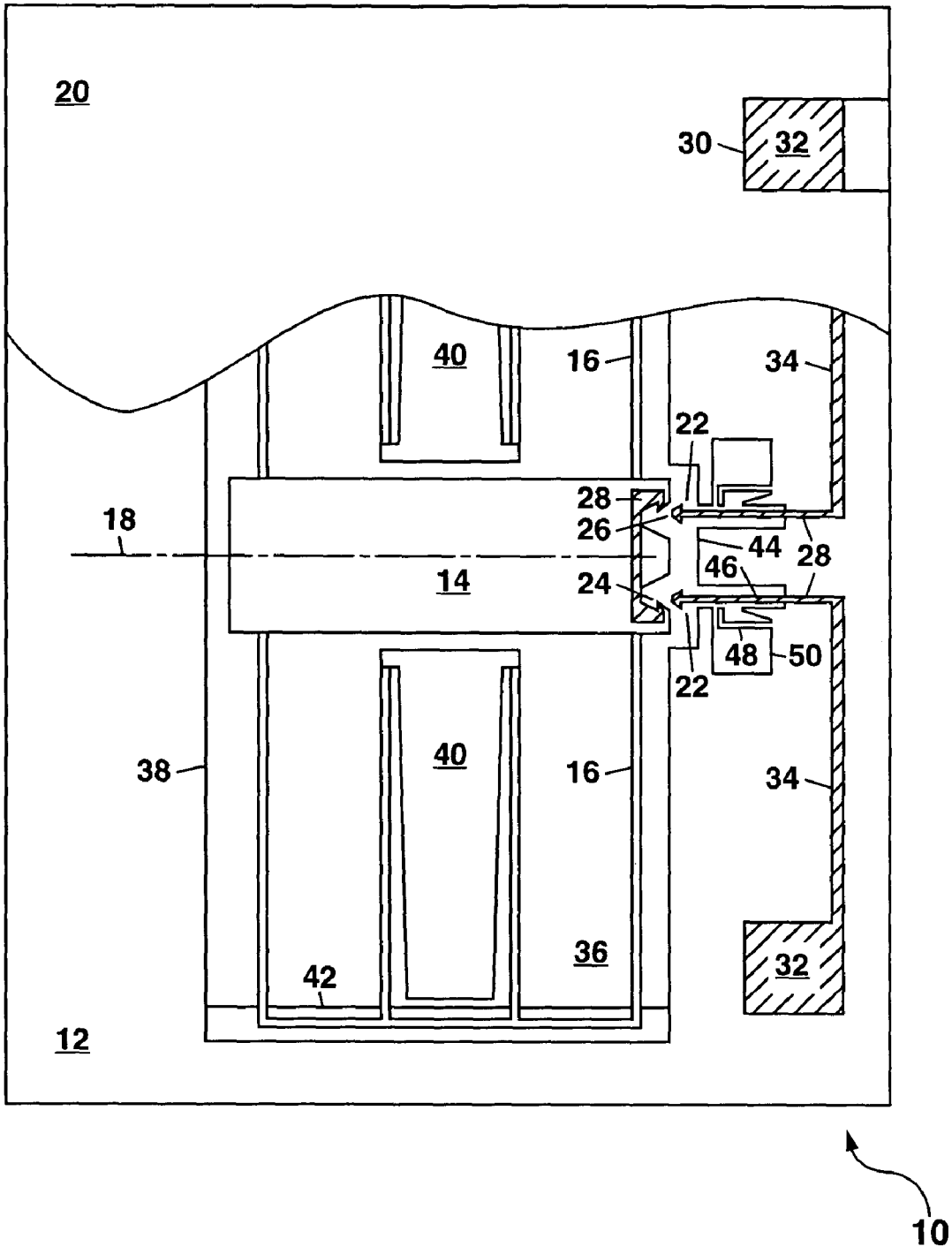
FIG. 1 shows a schematic plan view of a first example of the acceleration-sensing apparatus of the present invention in an "as-fabricated" position and with a lid partially removed to show details therein.

Referring to FIG. 1, there is shown a schematic plan view of a first example of the acceleration-sensing apparatus 10 of the present invention. In FIG. 1, the apparatus 10 comprises a substrate 12, and a shuttle 14 (also referred to herein as a mass) which is suspended by a plurality of springs 16 for movement in the plane of the substrate 12 along an axis 18 in response to an applied acceleration component (i.e. a component of an applied acceleration which is oriented along the axis 18). The terms "acceleration component" and "acceleration event" will be used interchangeably herein. A lid 20 which generally overlies the substrate 12 has been partially removed in FIG. 1 to show details of the acceleration-sensing apparatus 10.

Figure 2:
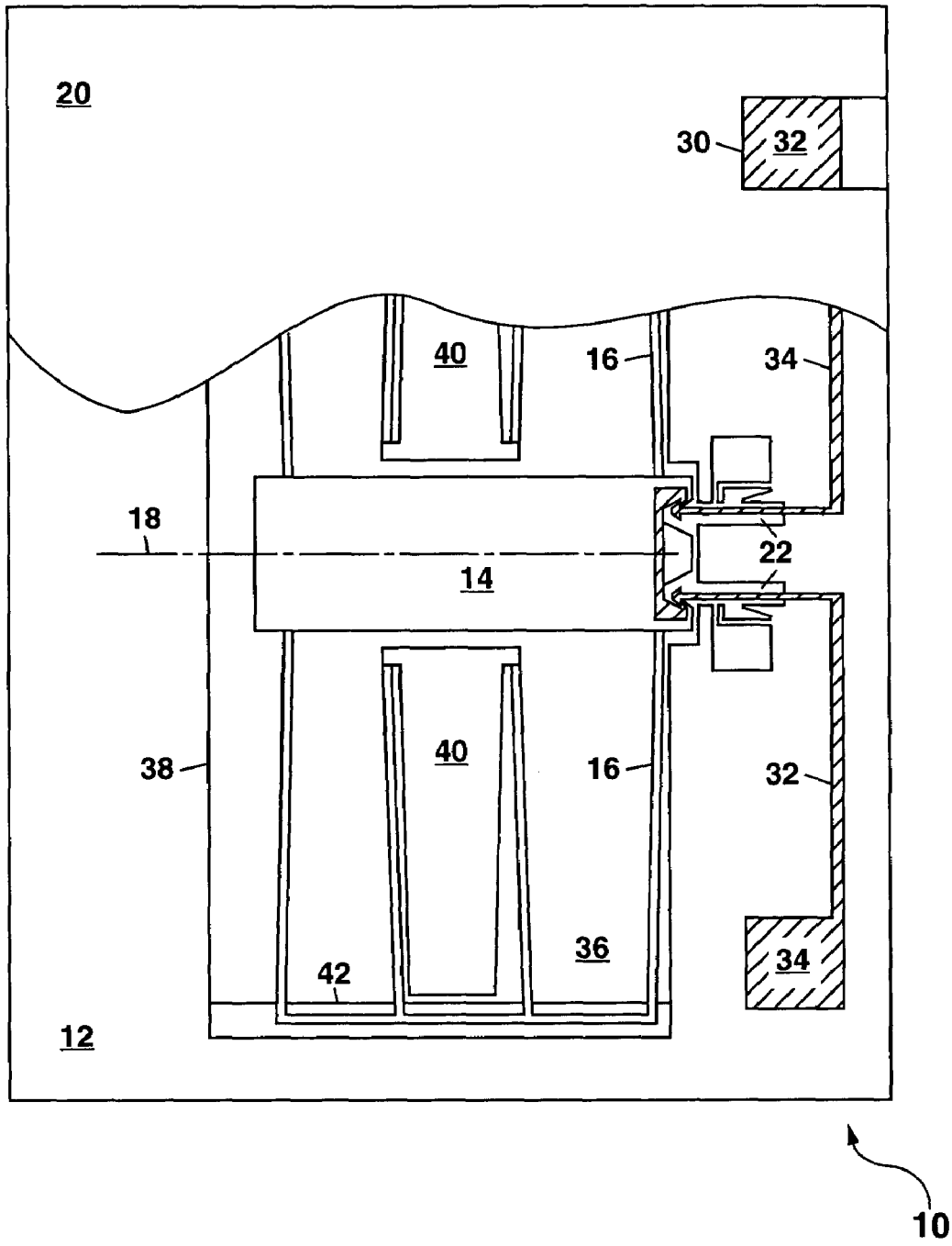
FIG. 2 shows the apparatus of FIG. 1 after experiencing an acceleration component of sufficient magnitude to urge a moveable shuttle therein past a latch and thereby switch the apparatus from an electrically "open" circuit state to a "closed" circuit state.

In FIG. 1, the apparatus 10 is shown in an "as-fabricated" position with the shuttle 14 being located proximate to a latch 22 which is used to capture the shuttle 14 after the occurrence of an acceleration component along the axis 18 of sufficient magnitude to move one or more tangs 24 on the suspended shuttle 14 past barbed ends 26 of the latch 22 as shown in FIG. 2. If the acceleration component is below a threshold value then the shuttle 14 will move by an extent insufficient for the shuttle 14 to be captured by the latch 22, and will return to its "as-fabricated" position after occurrence of the acceleration component by a restoring force provided by the springs 16. In this case, an electrical circuit formed by an electrically-conductive layer 28 disposed at least partially over the shuttle 14 and/or the tangs 24 and also over the latch 22 to make these elements of the apparatus 10 electrically conductive will remain in an electrically "open" state to indicate that an acceleration component above the threshold value has not yet occurred. The "open" state of the apparatus 10 can be read out through electrical connections which can be made through openings through the lid 20 to contact pads 32 and wiring 34 which can be formed on the substrate 12 from the electrically-conductive layer 28.

When an applied acceleration component exceeds the predetermined threshold value, the tangs 24 of the shuttle 14 will be urged past the barbed ends 26 of the latch 22 resulting in the shuttle 14 being captured by the latch 22 and held in place thereafter. In this case, the electrical circuit formed by the electrically-conductive layer 28 will be completed and placed into a "closed" electrically-conducting state so that an electrical current flowing through the layer 28 can indicate the occurrence of the acceleration component.

Thus, the apparatus 10 of the present invention acts to sense whether or not an acceleration component having a magnitude above the threshold value has occurred and to provide an electrical switch closure upon sensing the occurrence of such an acceleration component (also termed herein an acceleration event) and remains latched in the "closed" state thereafter. Multiple devices 10 having different threshold values for the acceleration component can be utilized to provide varying responses depending upon the magnitude of the acceleration component sensed (e.g. in an airbag deployment system utilizing a plurality of acceleration-sensing devices 10 each with a different predetermined acceleration threshold for activation, the amount of force with which one or more airbags are to be deployed can be varied in response to the severity of the impact as sensed by the devices 10). Additionally, multiple acceleration-sensing devices 10 can be deployed with different orientations to trigger different responses depending upon the direction of an impact (e.g. in an airbag deployment system, a plurality of devices 10 each having an axis 18 oriented along a particular direction can be used to an acceleration event occurring in that direction to provide a sensing capability for front and rear impacts and impacts on each side of an automobile, with each device 10 upon activation thereof triggering the deployment of particular airbags to provide protection appropriate to the situation). Those skilled in the art will understand that the term "acceleration" as used herein can also include a deceleration which can occur, for example, due to an impact.

Fabrication of the first example of the apparatus 10 of the present invention will now be described with reference to FIGS. 3A–3F which show a series of schematic cross-section views along the axis 18 in FIG. 1. The fabrication can be performed using a series of semiconductor process steps which include repeated steps for photolithographic mask definition and etching. Those skilled in the art will understand that although FIGS. 3A–3F describe the formation of a single device 10, which can have dimensions of generally a few millimeters on a side, in actuality a large number of devices 10 will usually be batch fabricated together and then separated for individual use.

Figure 3A:
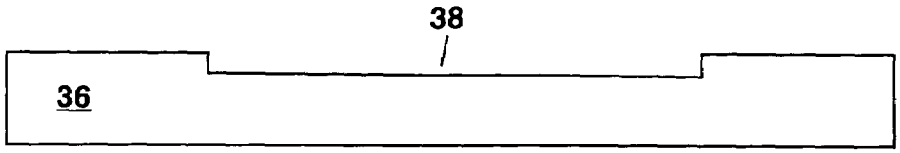
FIGS. 3A–3F show schematic cross-section views to illustrate steps in the fabrication of the apparatus of FIG. 1.

In FIG. 3A, a subbase 36 can be formed by providing a semiconductor wafer (e.g. comprising monocrystalline silicon) which can be, for example, about 500 μm thick. A photolithographically patterned photoresist mask (not shown) can be formed over a top side of the semiconductor wafer and an exposed portion of the wafer can then be etched to form a cavity 38 (see also FIG. 1) wherein the shuttle 14, springs 16 and latch 22 can be located. The cavity 38 can be about 100 μm deep. An portion of the subbase 36 within the cavity 38 can be masked during the etching to begin to build up a base 40 for use in supporting the springs 16 (see FIG. 1).

The etching can be performed using a deep reactive ion etch (DRIE) process such as that disclosed in U.S. Pat. No. 5,501,893 to Laermer, which is incorporated herein by reference. The DRIE process, which is particularly useful for bulk micromachining of the various elements of the apparatus 10, utilizes an iterative Inductively Coupled Plasma (ICP) deposition and etch cycle wherein a polymer etch inhibitor is conformally deposited as a film over the semiconductor wafer during a deposition cycle and subsequently removed during an etching cycle. The polymer film, which is formed in a $C_4F_8$/Ar-based plasma, deposits conformally over the photolithographically patterned photoresist mask, over any exposed portions of the semiconductor wafer, and over sidewalls of the cavity 38 being etched.

During a subsequent etch cycle using an $SF_6$/Ar-based plasma, the polymer film is preferentially sputtered from the cavity 38 or other features being etched in the semiconductor wafer and from the top of the photoresist mask. This exposes unmasked portions of the semiconductor wafer to reactive fluorine atoms from the $SF_6$/Ar-based plasma with the fluorine atoms being responsible for etching the exposed portions of the semiconductor wafer. After the polymer at the bottom of the cavity 38 has been sputtered away and the bottom etched by the reactive fluorine atoms, but before the polymer on the sidewalls of the cavity 38 has been completely removed, the polymer deposition step using the $C_4F_8$/Ar-based plasma is repeated. This cycle continues until a desired etch depth is reached. Each polymer deposition and etch cycle generally lasts only for a few seconds (e.g. $\leqq 10$ seconds). The net result is that features can be anisotropically etched into the semiconductor wafer or completely through the semiconductor wafer while maintaining substantially straight sidewalls (i.e. with little or no tapering).

In forming the cavity 38, a shelf 42 (see FIG. 1) can be formed underneath the springs 16 to limit vertical movement of the springs 16 in response to other acceleration components which are not directed along the axis 18. In this case, two DRIE etch steps with separate photolithographically patterned photoresist masks can be performed so that the shelf 42 can be etched to a depth of, for example, 10 μm below a top surface of the semiconductor wafer. This can be done, for example, by providing the two photoresist masks over the semiconductor wafer and initially etching down to a depth of 90 μm. One of the photoresist masks, which was protecting an area of the wafer reserved for each shelf 42 from being etched during a first DRIE etch step, can then be removed and a second DRIE etch step performed to etch the cavity 38 including the shelves 42 downward another 10 μm.

After the DRIE etching steps, the remaining photoresist masks can be removed and the wafer cleaned, as needed, to remove any photoresist residue. A thermal oxide layer about 1 μm thick can then be formed on the semiconductor wafer at an elevated temperature (e.g 1050° C.).

Figure 3B:
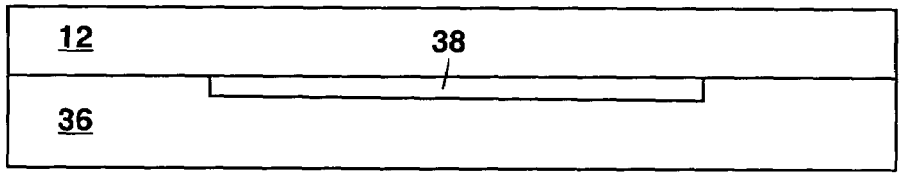

In FIG. 3B, a second semiconductor wafer (e.g. comprising monocrystalline silicon) used to form the substrate 12 can be prepared for fusion bonding by forming a 1-μm-thick thermal oxide layer on each side thereof as described above. Fusion bonding (also termed wafer bonding or diffusion bonding) can then be used to permanently attach the substrate 12 to the subbase 36. The fusion bonding can be performed at an elevated temperature of 1050° C. in an oxygen ambient for one hour with the surfaces of the substrate 12 and the subbase 36 being brought into intimate contact with each other. After the substrate 12 has been fusion bonded to the subbase 36, the substrate 12 can be lapped and polished down to a thickness of, for example, 100 μm.

Figure 3C:
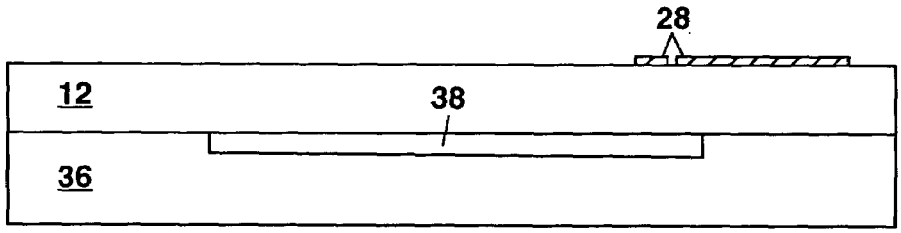

In FIG. 3C, the electrically-conductive layer 28 can be deposited and patterned on the substrate 12 to form the contact pads 32 and wiring 34 prior to etching of the substrate 12. The electrically-conductive layer 28 can be protected from subsequent etching steps by an overlying photolithographically-patterned photoresist layer (not shown). The electrically-conductive layer 28 is electrically isolated from the substrate 12 by the thermal oxide layer, although if needed openings can be etched through the thermal oxide layer to provide an electrical connection between the layer 28 and elements formed from the substrate 12 (e.g. when forming a microelectromechanical actuator as will be described hereinafter with reference to FIGS. 5–7). The electrically-conductive layer 28, can comprise a layer of a metal (e.g. gold or aluminum) deposited by evaporation, sputtering or electroplating to a layer thickness of, for example, 0.5–3 μm or alternately a doped semiconductor material (e.g. polycrystalline silicon doped with boron or phosphorous during chemical vapor deposition) which can be deposited to about the same layer thickness. After deposition, the electrically-conductive layer 28 can be patterned by etching (e.g. reactive ion etching) or lift-off.

Additional metallization can be deposited on vertically-oriented contacting surfaces of the tangs 24 on the shuttle 14 and the barbed ends 26 of the latch 22 after fabrication of these elements has been completed as will be described hereinafter. This additional metallization can be performed using a shadow mask and tilting of the substrate 12 to allow deposition at different angles (e.g. ±45°) to coat the contacting surfaces of the tangs 24 on the shuttle 14 and the barbed ends 26 of the latch 22.

Figure 3D:
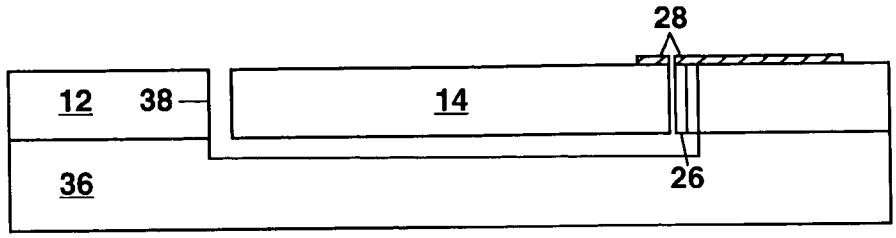

In FIG. 3D, another DRIE etch step is utilized to form the various elements in the substrate 12 including the shuttle 14, which can be formed as a flat plate, and the springs 16 and latch 22. Additionally, this DRIE etch step builds up the base 40 for supporting the springs 16, and also builds up the cavity 38. The remainder of the substrate 12 forms a frame about the shuttle 14, springs 16 and latch 22 with the subbase 36 being attached to this frame. A portion of this frame can also be used to form a stop 44 as shown in FIGS. 1 and 2 to prevent the shuttle 14 from moving much beyond the position wherein it is captured by the latch 22.

The latch 22 can be formed with a pair of cantilevered beams 46 with a barbed end 26 being formed at a free end of each cantilevered beam 46. The thickness of the barbed ends 26 and the beams 46 in the latch 22 are generally the same as the thickness of the shuttle 14 (e.g. 100 μm). The width of each beam 46 is much smaller than the thickness thereof so that the beams 46 can act as springs and move in the plane of the substrate 12 as each tang 24 is urged past one of the barbed ends 26 in response to the applied acceleration component. The barbed ends 26 then lock the shuttle 14 in place and provides the electrical contact with each tang 24 to complete the electrical circuit as shown in FIG. 2. Although the barbed ends 26 of the latch 22 are shown as being double-sided in FIGS. 1 and 2, in other embodiments of the present invention, the barbed ends 26 can be single-sided.

An optional latch-release detent 48 can be provided in an opening 50 proximate to each cantilevered beam 46 for use in releasing the latch 22 and thereby disengaging the shuttle 14 and allowing the shuttle 14 to return to its "as-fabricated" position as shown in FIG. 1. The latch-release detent 48 is useful for testing of the apparatus 10 to determine the threshold value for the acceleration component which is related to a threshold value of an extent of movement of the shuttle 14 required for latching thereof. The detents 48 can be simultaneously moved using mechanical probes in the openings 50 to press against the detents 48 and thereby move the barbed ends 26 away from the tangs 24 to release the shuttle 14. The detents 48 can be formed at the same time as the other elements in the latch 22 using the DRIE etch step described with reference to FIG. 3D and can have a thickness substantially equal to the thickness of the latch 22 and shuttle 14.

The springs 16 are preferably formed with a folded and interconnected construction as shown in FIG. 1 with one end of each interconnected spring 16 being attached to a support 40, and with the other end of each interconnected spring 16 being attached to the shuttle 14. This arrangement of the springs 16 takes up less space than if the springs 16 were unfolded, and it also allows the springs 16 on each side of the shuttle 14 to act in unison. The thickness of the springs 16 is generally the same as that of the shuttle 14 (e.g. 100 μm), with the width of each spring 16 generally being in the range of 2–10 μm and with the exact width being defined by the magnitude (i.e. threshold value) expected for the applied acceleration component and other factors including the mass of the shuttle 14. For airbag sensing, the threshold value of the acceleration component can be, for example, in a range of 5–50 Gs (where G is the acceleration due to gravity); whereas for other applications (e.g. munitions) the threshold value for the acceleration component can be preselected to be up to several thousand Gs or larger. An overall length of each spring 16 can be up to several millimeters. Excessive vertical movement of the springs 16 during the time when the acceleration component is applied to the apparatus 10 can be limited by underlying shelves 42 which can be optionally formed in the subbase 36 (see FIG. 1) and in an overlying lid 20.

Figure 3E:
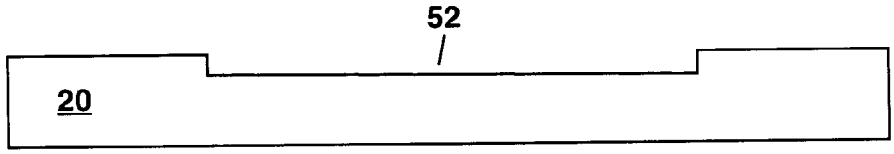

In FIG. 3E, the lid 20 for the apparatus 10 can be formed from yet another semiconductor wafer (e.g. comprising silicon) in a manner similar to fabrication of the subbase 36 as previously described with reference to FIG. 3A. A photolithographically patterned photoresist mask (not shown) can be provided over a top side of the semiconductor wafer exposing a portion of the wafer wherein a recess 52 is to be formed. The recess 52, which can be, for example, 100 μm deep, is then etched into the semiconductor wafer as shown in FIG. 3E using a DRIE etch step. The recess 52 can have the shape of the cavity 38 etched into the subbase 36, and can optionally include one or more shelves 42 as previously described to limit vertical movement of the springs 16.

A second DRIE etch step can be performed to etch completely through the semiconductor wafer in FIG. 3E on a side thereof opposite the recess 52 using another photolithographically-defined photoresist mask in order to form the openings as shown in FIG. 1 which provide access to the contact pads 32 and allow the attachment of wires thereto to form external electrical connections to the acceleration-sensing apparatus 10. Once the photoresist mask has been removed and the semiconductor wafer cleaned, a thermal oxide layer can be formed over the semiconductor wafer as previously described with a thickness of, for example, 1 μm.

In other embodiments of the present invention, electrically-conductive vias (not shown) can be substituted for the openings 30. The electrically-conducting vias can be formed by depositing a metal (e.g. gold, aluminum or tungsten) into openings formed through the lid 20. Electrical wiring and contact pads (not shown) can then be deposited and patterned on a surface of the lid 20 opposite the recess 52 for use in making electrical connections to the device 10.

Figure 3F:
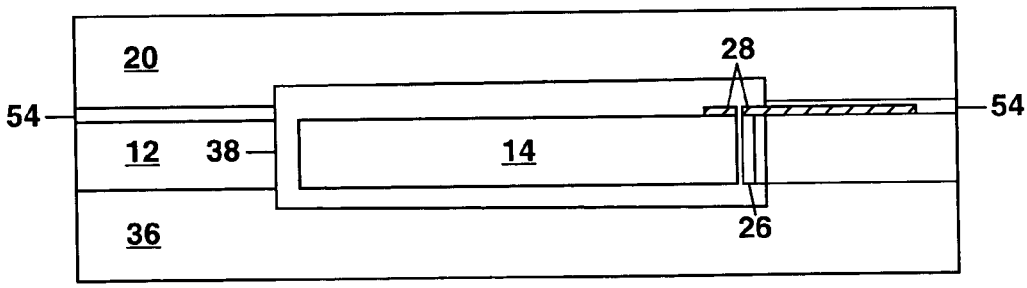

In FIG. 3F, the lid 20 has been inverted and attached to the frame formed from the remainder of the substrate 12 to complete the formation of the device 10. This attachment can be performed, for example, using an adhesive 54 (e.g. an epoxy). In other embodiments of the present invention, the lid 20 can be attached to the frame by fusion bonding in a manner similar to the fusion bonding of the subbase 36 to the substrate 12 as previously described with reference to FIG. 3B. The lid 20 and the subbase 36 together form a package about the substrate 12 encapsulating the shuttle 14, springs 16 and latch 22. The completed device 10 can be further packaged, as needed, in a conventional integrated circuit (IC) package (e.g. a dual-in-line package or a surface-mount package). In some instances, multiple devices 10 will be included in a common package as described previously.

Figure 4:
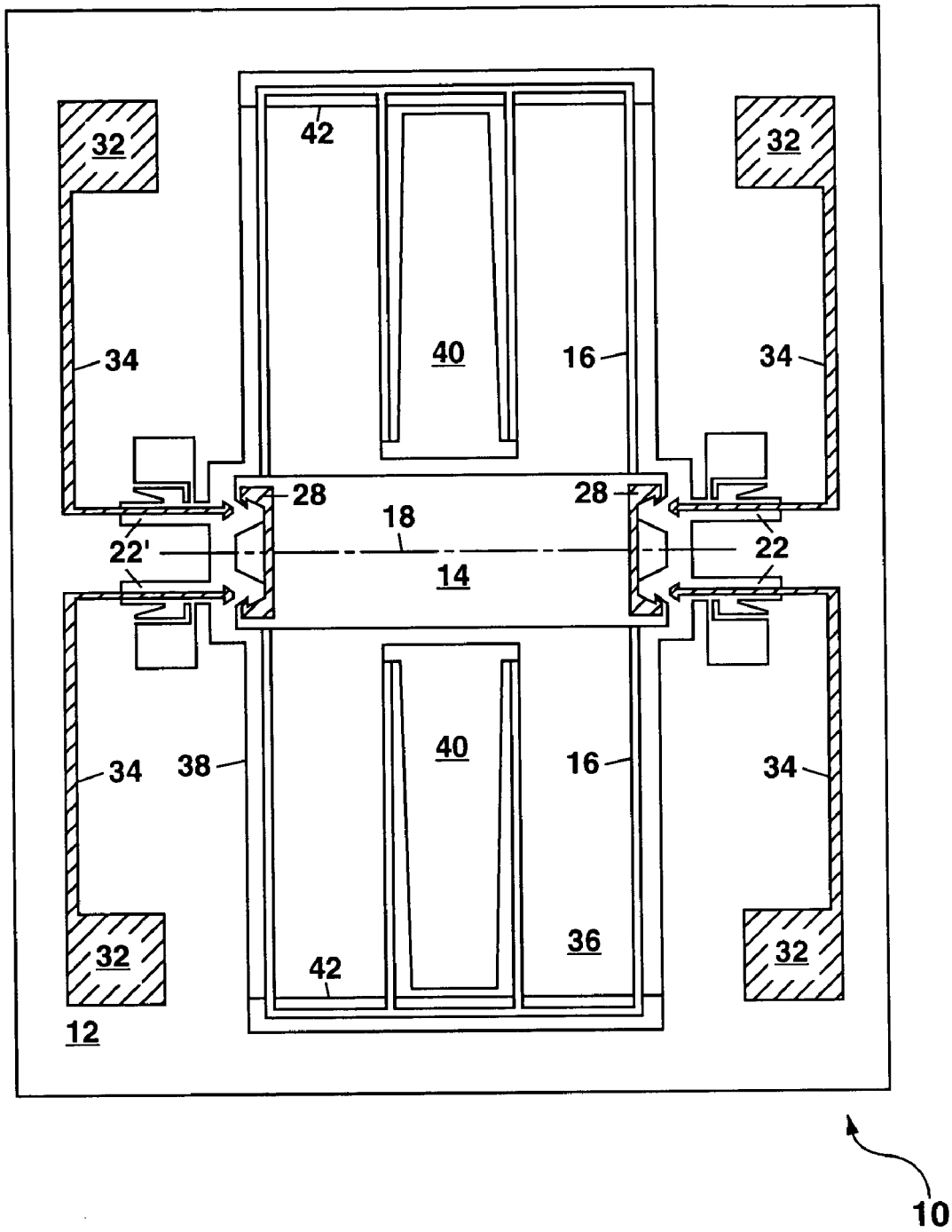
FIG. 4 shows a schematic plan view of a second example of the apparatus of the present invention in an "as-fabricated" position and with the lid removed to show details inside the device.

A second example of the acceleration-sensing apparatus 10 is shown schematically in plan view in FIG. 4. The apparatus 10 in FIG. 4 comprises a shuttle 14 (i.e. a suspended mass) which is moveable between a pair of latches 22 and 22' so that the apparatus 10 can sense an acceleration component (i.e. an acceleration event) which can be in either direction along an axis 18 of motion of the shuttle 14. When used, for example, as an impact sensor in an airbag deployment system to trigger the inflation of one or more airbags in an automobile, the device 10 of FIG. 4 can be oriented along a front-to-rear axis in the automobile so that it is responsive to either a frontal impact or a rear impact. Another device 10 as shown in FIG. 4 can be mounted with its axis 18 oriented at 90° to a direction of motion of the automobile in order to sense side impacts, with the particular latch 22 or 22' capturing the shuttle 14 indicating on which side of the automobile the impact occurred and thereby triggering one or more airbags on that side.

In operation, the shuttle 14 in the acceleration-sensing apparatus 10 of FIG. 4 will be urged against one of the latches 22 or 22' and will be locked in place whenever an acceleration event occurs of sufficient magnitude for latching of the device 10. It should be noted that only one such acceleration event will be sensed with the apparatus 10 of FIG. 4 since, once an acceleration event occurs, the shuttle 14 will become locked in place and will generally not be released in response to an acceleration event in the opposite direction. The second example of the apparatus 10 can be fabricated in a manner similar to that previously described with reference to FIGS. 3A–3F.

Figure 5:
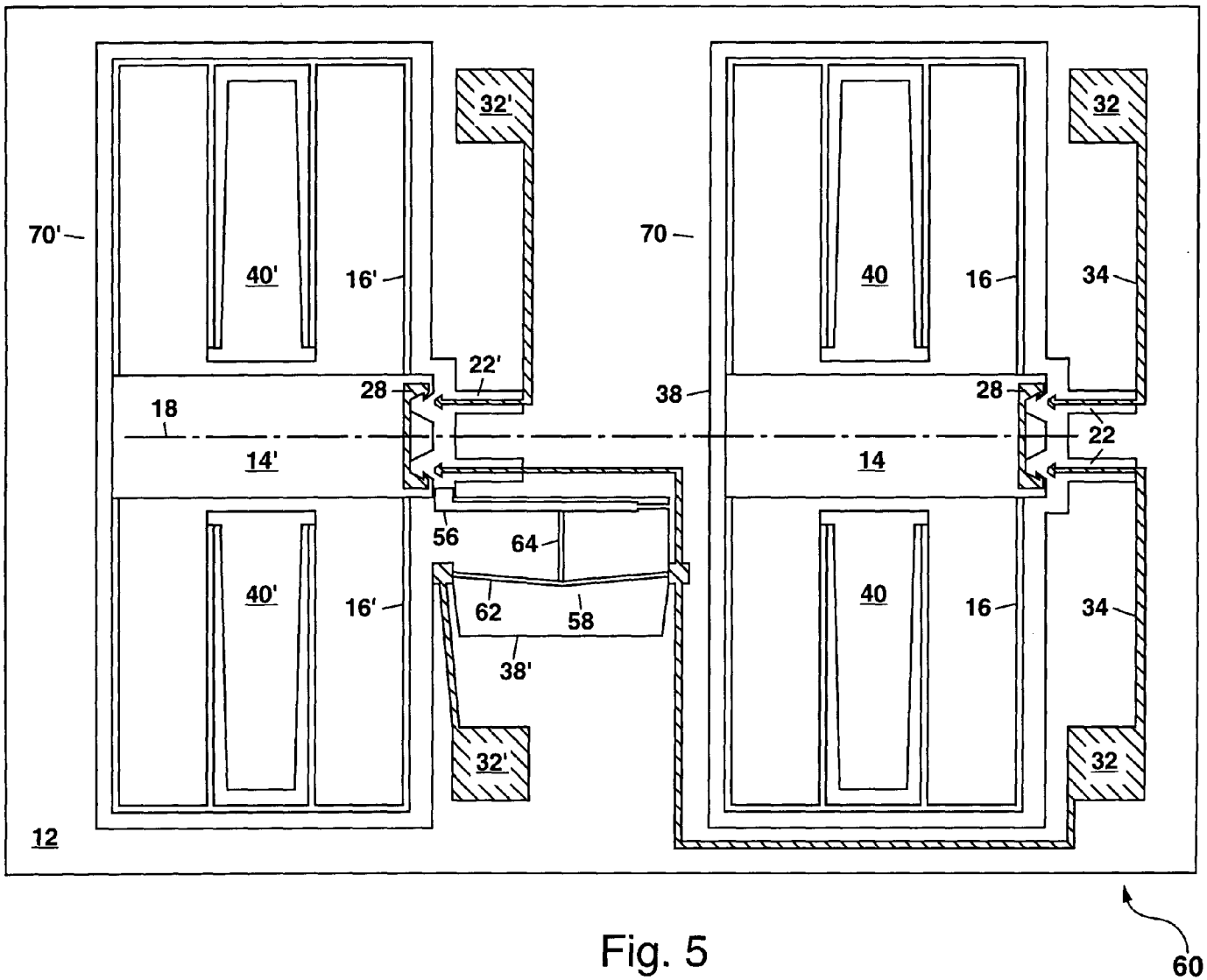
FIG. 5 shows a schematic plan view of a third example of the apparatus of the present invention as a two-stage acceleration sensor, with this device being shown in an "as-fabricated" state.

FIG. 5 schematically illustrates in plan view a third example of the apparatus of the present invention in an "as-fabricated" position with the lid 20 removed to show details inside the apparatus. In the third example of the present invention, a two-stage acceleration-sensing apparatus 60 is provided which can be read out to determine whether two acceleration events spaced apart by a time interval, which can be as small as a fraction of a second, have occurred. The occurrence of each acceleration event provides a completed electrical circuit which can be read out to determine whether that acceleration event has occurred.

The apparatus 60 in FIG. 5 comprises a pair of acceleration sensors 70 and 70' for measuring a pair of acceleration events occurring in sequence along a common axis 18, or along different axes which can be oriented at an arbitrary angle with respect to each other in other embodiments of the present invention. In FIG. 5, a first acceleration sensor 70 comprises a shuttle 14 (i.e. a mass which can be formed as a flat plate) suspended on springs 16 and a latch 22, with these elements being formed similarly to the first example of the present invention as previously described with reference to FIGS. 1–3. The first acceleration sensor 70 is responsive to a first acceleration event $A_1$ indicated by a horizontal arrow in FIG. 6, with the first acceleration event $A_1$ producing an oppositely directed force on the shuttle 14 which urges the shuttle 14 past the latch 22 which thereby captures the shuttle 14 and forms a completed electrical circuit between a pair of contact pads 32 due to the electrically-conductive layer 28 disposed on the latch 22 and on the shuttle 14 as previously described with reference to FIG. 3C. This completed electrical circuit can be used to indicate the occurrence of the first acceleration event $A_1$ and also to enable the operation of a second acceleration sensor 70' as described hereinafter.

Figure 6:
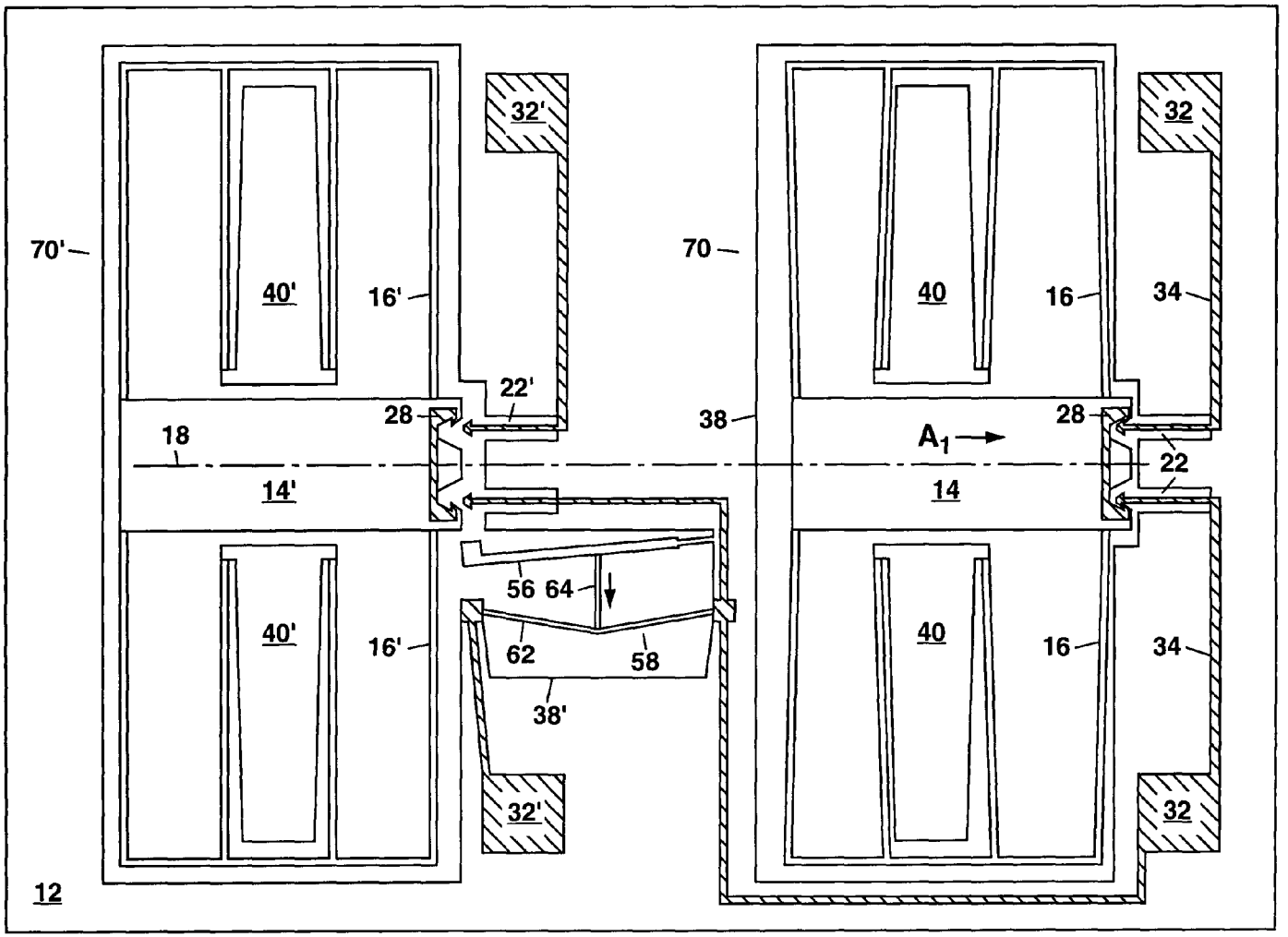
FIG. 6 shows the apparatus of FIG. 5 after the occurrence of a first acceleration event $A_1$ which completes an electrical circuit which is then used to disengage a moveable stop to enable sensing of a second acceleration event $A_2$ which can occur thereafter.

During the first acceleration event $A_1$, the second acceleration sensor 70' having a shuttle 14' suspended on springs 16' and a latch 22' is rendered nonresponsive due to a moveable stop 56 which is fabricated in place in the second acceleration sensor 70' between the shuttle 14' and the latch 22' to limit motion of the shuttle 14' (see FIG. 5). The second acceleration sensor 70' further includes a microelectromechanical (MEM) actuator 58 which is operatively coupled to move the stop 56 away from the shuttle 14' only after a switch closure (i.e. the completed electrical circuit) in the first acceleration sensor 70 due to the shuttle 14 being captured by the latch 22. In FIG. 6, once the first acceleration event $A_1$ has occurred, the electrical signal can flow between the contact pads 32 in the first acceleration sensor 70 and therefrom through the MEM actuator 58 and to a lower contact pad 32' (e.g. a ground electrical connection) in the second acceleration sensor 70' (see FIG. 6).

The MEM actuator 58, which is shown by way of example as a bent-beam thermal actuator 58 which comprises a bent beam 62 that can be resistively heated by the electrical signal (i.e. an electrical current) causing the bent beam 62 to expand away from the stop 56 as indicated by the vertical arrow in FIG. 6. This movement of the bent beam 62 is coupled to the stop 56 through a linkage 64 to move the stop 56 out of the way of the shuttle 14'. The stop 56 is flexibly attached to the substrate 12 to provide a hinged movement in the plane of the substrate 12 as shown in FIG. 6. The time required for activating the MEM actuator 58 and moving the stop 56 can be on the order of one millisecond or less.

The moveable stop 56 and the MEM actuator 58 in FIGS. 5 and 6 can be formed from the substrate 12 in a cavity 38' together with the other elements of the second acceleration sensor 70' and with a thickness being less than or equal to that of the shuttle 14'. Fabrication of the moveable stop 56 and the MEM actuator 58 can be performed using the same DRIE etching step previously described with reference to FIG. 3D that is used to form the other elements of the acceleration sensors 70 and 70' from the substrate 12. To form the MEM actuator 58 with a thickness less than that of the shuttle 14', two DRIE etch steps can be used, with a first photoresist mask defining features of the MEM actuator 58 and with a second photoresist mask allowing the features of the MEM actuator 58 to be etched downward partially through the substrate 12 in a manner similar to that described previously for forming the shelves 42 in the subbase 36. To provide electrical conductivity through the bent beam in the MEM actuator 58, a doped substrate 12 can be used, or alternately the bent beam 62 can be doped for electrical conductivity by ion implantation with the substrate tilted at an angle (e.g. ±45°).

Figure 7:
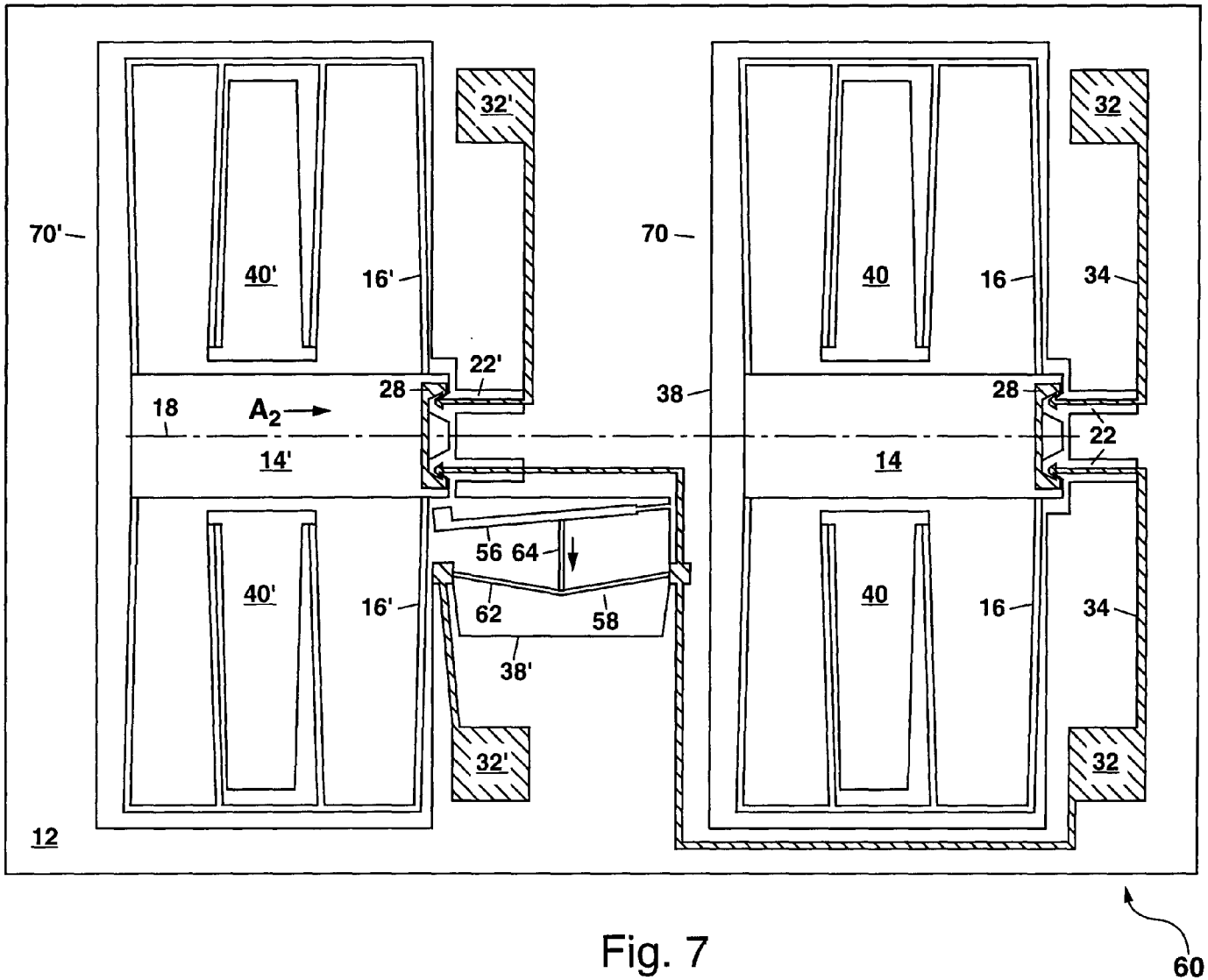
FIG. 7 shows the apparatus of FIGS. 5 and 6 after the occurrence of the second acceleration event $A_2$.

In FIG. 6, with the stop 56 moved out of the way of the shuttle 14' after the occurrence of the first acceleration component $A_1$, the shuttle 14' in the second acceleration sensor 70' is free to respond to a second acceleration event $A_2$ which can then urge the shuttle 14' past the latch 22' as shown in FIG. 7 to capture the shuttle 14' and thereby complete an electrical circuit through both acceleration sensors 70 and 70' (i.e. between the upper contact pads 32 and 32' in FIG. 7). The completed electrical circuit then provides an indication that the two acceleration events, which are spaced apart in time, have occurred. Each acceleration event $A_1$ and $A_2$ can also be detected with the apparatus 60 in addition to detecting the completion of both acceleration events $A_1$ and $A_2$.

In other embodiments of the present invention, additional acceleration sensors having moveable stops 56 and MEM actuators 58 can be ganged together as described with reference to FIGS. 5–7 to provide an indication of additional acceleration events spaced apart in time. The suspended masses used to form the shuttles 14 and 14' can either be substantially equal in mass or can be different in mass depending upon the magnitude of the acceleration events $A_1$ and $A_2$ to be detected with the apparatus 60. The mass of each shuttle 14 and 14' in combination with the compliance of the springs 16 and 16' used to suspend each mass and the compliance of the cantilevered beams in the latches 22 and 22' will, in general, determine the magnitude of the acceleration events $A_1$ and $A_2$ required for latching of the shuttle 14 or 14' in each acceleration sensor 70 and 70'. Additionally, although the two acceleration events $A_1$ and $A_2$ are shown in the same direction in the example of FIGS. 5–7, this need not be the case for other embodiments of the present invention. For example, the two acceleration sensors 70 and 70' can be aligned to respond to oppositely directed acceleration events $A_1$ and $A_2$. As another example, the two acceleration sensors 70 and 70' can be aligned orthogonally to each other to detect two orthogonally-directed acceleration events $A_1$ and $A_2$.

Those skilled in the art will understand that other types of MEM actuators including electrostatic comb actuators and capacitive plate electrostatic actuators (also known as parallel-plate electrostatic actuators or "zip" actuators) can be substituted for the bent-beam thermal actuator 58 used in the third example of the present invention in FIGS. 5–7. Such MEM actuators can be formed using the same series of process steps which have been described with reference to FIGS. 3A–3F and which can be used to form the various elements of the acceleration sensors 70 and 70'. Electrical wiring to the MEM actuators can be formed from the electrically-conductive layer 28 as previously described with reference to FIG. 3C.

Other applications and variations of the present invention will become evident to those skilled in the art. Although, the various examples of the apparatus 10 of the present invention have been described as being fabricated by bulk micromachining of semiconductor wafers, those skilled in the art will understand that other types of materials including metals and insulators can be used to fabricate other embodiments of the present invention. Additionally, those skilled in the art will understand that certain embodiments of the present invention can be fabricated using LIGA (an acronym for "Lithographic Galvanoforming Abforming") wherein the various elements therein including the shuttle 14, the springs 16 and the latch 22 can be built up from an electroplated metal (e.g. nickel or copper). LIGA, which is well-known in the art, is a process whereby millimeter-sized mechanical or electromechanical devices can be formed by photolithographically defining a removable mask (e.g. comprising PMMA) using an x-ray or synchrotron source and then plating or depositing metal into the mask to build up the structure of a device and thereafter dissolving away the mask to complete the fabrication of the device.

The matter set forth in the foregoing description and accompanying drawings is offered by way of illustration only and not as a limitation. The actual scope of the invention is intended to be defined in the following claims when viewed in their proper perspective based on the prior art.

What is claimed is:

1. An apparatus for sensing acceleration, comprising:

(a) a substrate;

(b) a shuttle formed from the substrate and suspended for movement along an axis in response to an applied acceleration component;

(c) a latch for capturing and holding the shuttle when an extent of movement of the shuttle exceeds a threshold value in response to the applied acceleration component; and (d) an electrical circuit formed, at least in part, from the shuttle for indicating when the shuttle is captured by the latch and thereby indicating the occurrence of the applied acceleration component.

2. The apparatus of claim 1 wherein the substrate comprises a semiconductor substrate.

3. The apparatus of claim 2 wherein the semiconductor substrate comprises silicon.

4. The apparatus of claim 1 wherein the shuttle is suspended by a plurality of springs, with each spring being attached at one end thereof to the shuttle and attached at another end thereof to a support formed, at least in part, from the substrate.

5. The apparatus of claim 1 wherein the latch comprises at least one cantilevered beam having a catch at a free end thereof.

6. The apparatus of claim 5 wherein the catch comprises a barb formed at the free end of each cantilevered beam.

7. The apparatus of claim 1 further including a package formed about the substrate, with the package further comprising a subbase attached to an underside of the substrate, and a lid attached to a topside of the substrate.

8. The apparatus of claim 7 wherein the subbase is fusion bonded to the substrate.

9. The apparatus of claim 1 wherein the electrical circuit comprises an electrically-conductive layer disposed over at least a portion of the mass and over at least a portion of the latch.

10. The apparatus of claim 9 wherein the electrically-conductive layer comprises a metal.

11. An apparatus for sensing a first acceleration event and a second acceleration event separated in time, comprising:

(a) a first acceleration sensor for sensing the first acceleration event, with the first acceleration sensor further comprising a first suspended mass moveable in response to the first acceleration event and a first latch for capturing the first mass after movement thereof in response to the first acceleration event, with the first mass upon capture by the first latch forming a completed electrical circuit; and (b) a second acceleration sensor for sensing the second acceleration event, with the second acceleration sensor further comprising a second suspended mass moveable in response to the second acceleration event and a second latch for capturing the second mass after movement thereof in response to the second acceleration event, with the second mass upon capture by the second latch forming another completed electrical circuit, and further including a moveable stop located in a path of the second mass for limiting movement of the second mass until after formation of the completed electrical circuit in the first acceleration sensor.

12. The apparatus of claim 11 wherein the first and second masses are substantially equal in mass.

13. The apparatus of claim 11 wherein the first and second masses are different in mass.

14. The apparatus of claim 11 wherein the first and second masses are formed from a common substrate.

15. The apparatus of claim 14 wherein the common substrate comprises silicon.

16. The apparatus of claim 11 wherein the stop is moved out of the path of the second mass by a microelectromechanical actuator.

17. The apparatus of claim 16 wherein the microelectromechanical actuator comprises an electrostatic actuator or a thermal actuator.

18. The apparatus of claim 11 wherein each latch comprises a cantilevered beam having a barbed end for engagement with the mass located proximate thereto.

19. The apparatus of claim 11 wherein each electrical circuit comprises an electrically-conductive layer disposed over at least a portion of one of the masses and one of the latches located proximate thereto.

20. The apparatus of claim 19 wherein the electrically-conductive layer comprises a metal.

* * * * *